US005947563A

United States Patent [19]

Klimenko

[11] Patent Number: 5,947,563

[45] Date of Patent: Sep. 7, 1999

[54] INFLATABLE LEISURE CHAIR

[75] Inventor: K. "Conny" Klimenko, Los Angeles, Calif.

[73] Assignee: Sevylor U.S.A., Inc., Los Angeles, Calif.

[21] Appl. No.: 09/046,845

[22] Filed: Mar. 11, 1998

[51] Int. Cl.[6] ..... A47C 7/02

[52] U.S. Cl. ..... 297/452.41; 297/DIG. 3

[58] Field of Search ..... 297/452.41, 284.6, 297/DIG. 3; 5/455, 654; 441/130, 132

[56] References Cited

U.S. PATENT DOCUMENTS

| | | | |
|---|---|---|---|
| 3,408,107 | 10/1968 | Savage | 297/452.41 |
| 3,740,095 | 6/1973 | Nail | 297/452.41 |
| 4,592,589 | 6/1986 | Hellwig | 297/452.41 |
| 5,360,360 | 11/1994 | Peterson | 297/DIG. 3 X |

FOREIGN PATENT DOCUMENTS

| | | | |
|---|---|---|---|
| 1601475 | 10/1970 | France | 297/DIG. 3 |

*Primary Examiner*—Laurie K. Cranmer
*Attorney, Agent, or Firm*—Dean W. Russell; Kilpatrick Stockton LLP

[57] ABSTRACT

Disclosed is an inflatable leisure chair which can be quickly inflated to serve as a comfortable sofa for use indoors and/or outdoors. A plurality of I-shaped supporting beams made of plastic material of high tensile strength are radio heated to and between inner surfaces of a seat and a bottom of the inflatable chair to reinforce the space in the inflatable chair below the seat. The inflatable leisure chair can be quickly inflated for use and deflated for convenient storage and carrying.

4 Claims, 3 Drawing Sheets

INFLATABLE LEISURE CHAIR

BACKGROUND OF THE INVENTION

Following the quick developments of our society in industrial and commercial fields, most people are always busy in their work and neglect their activities in leisure time. Fatness and all kinds of illnesses in connection with fatness ruthlessly attack many people. Fortunately, at the forthcoming end of the twentieth century, people have realized the importance of adequate leisure activities to Now. Now, there are various kinds of products developed and available in the markets to meet the needs of people in their leisure activities. Many of us would usually enjoy a weekend or other leisure time with our family by, for example, visiting some resorts in the suburbs. Therefore, it is desirable to develop a simple, light, and collapsible leisure chair which can be conveniently carried or stored and is comfortably soft for sitting indoors and/or outdoors, so that people can enjoy a soft and comfortable chair during their outdoor activities just as they do in their home.

SUMMARY OF THE INVENTION

A primary object of the present invention is to provide an inflatable leisure chair which has a simple and light structure and can be conveniently and quickly inflated to serve as a comfortably soft chair.

Another object of the present invention is to provide an inflatable leisure chair which can be deflated and collapsed to a small volume for convenient carrying or transporting.

A further object of the present invention is to provide an inflatable leisure chair which includes I-shaped supporting beams to reinforce a space below a seat portion of the chair, so that the seat of the inflatable leisure chair may bear considerable load without becoming deformed.

A still further object of the present invention is to provide an inflatable leisure chair which is formed from multiple pieces of plastic sheets in the same or different colors to give the chair a unique, bright, and pleasant appearance.

To achieve the above and other objects, the present invention provides an inflatable leisure chair formed from multiple pieces of plastic sheets in the same or different colors by radio heating them together to form a back, two armrests, a seat, and a bottom of a chair. A space is defined by the radio heated plastic sheets, into which air can be filled via a valve provided on the inflatable leisure chair. A plurality of I-shaped supporting beams made of plastic material of high tensile strength are radio heated to and between inner surfaces of the seat and the bottom of the inflatable chair to reinforce a portion of the space below the seat.

DETAILED DESCRIPTION OF THE PREFERRED EMBODIMENTS

Figure 1:
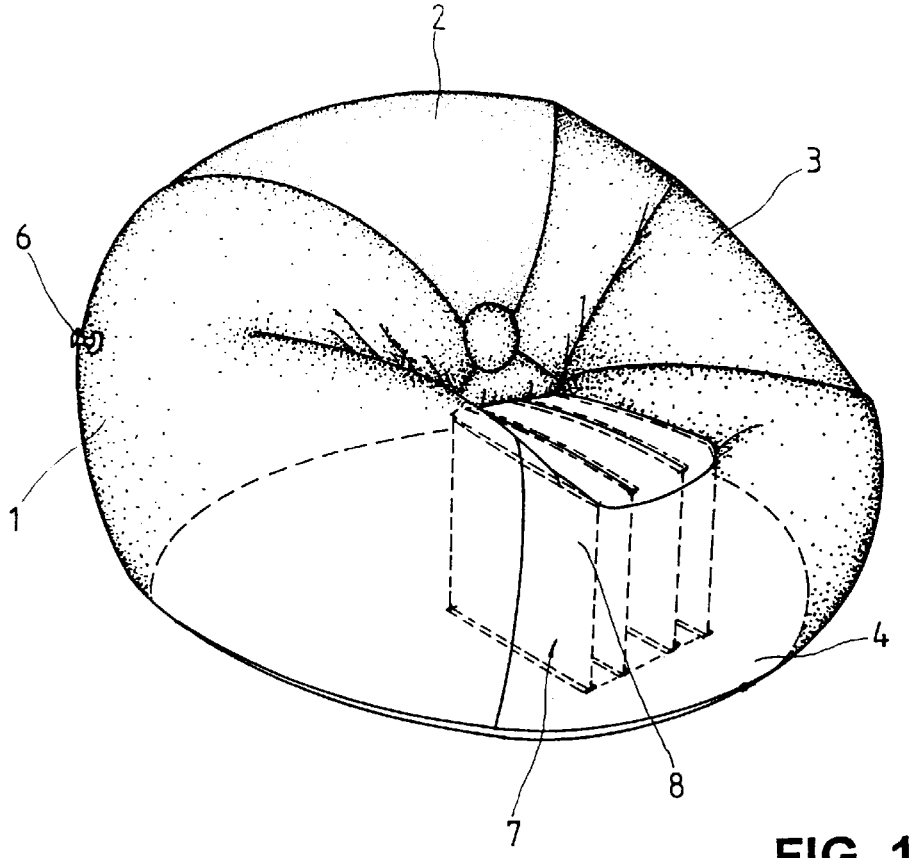
FIG. 1 is a perspective view of an inflatable leisure chair according to an embodiment of the present invention with a part of it being cut away to better show an internal structure of the chair.
Figure 2:
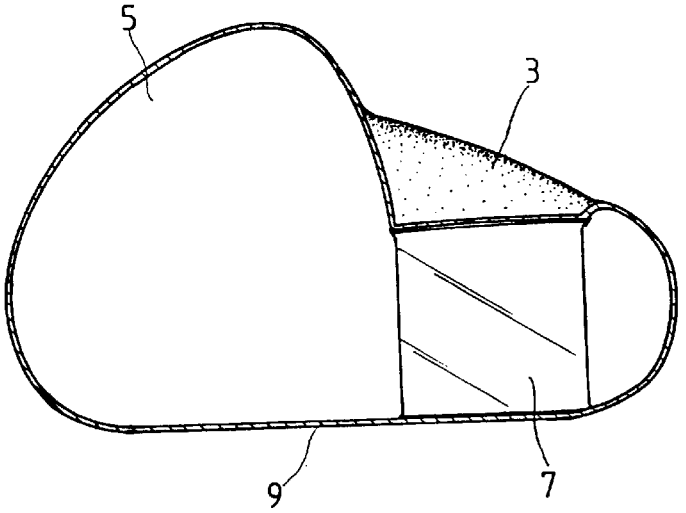
FIG. 2 is a side sectional view of the inflatable leisure chair of FIG. 1.
Figure 3:
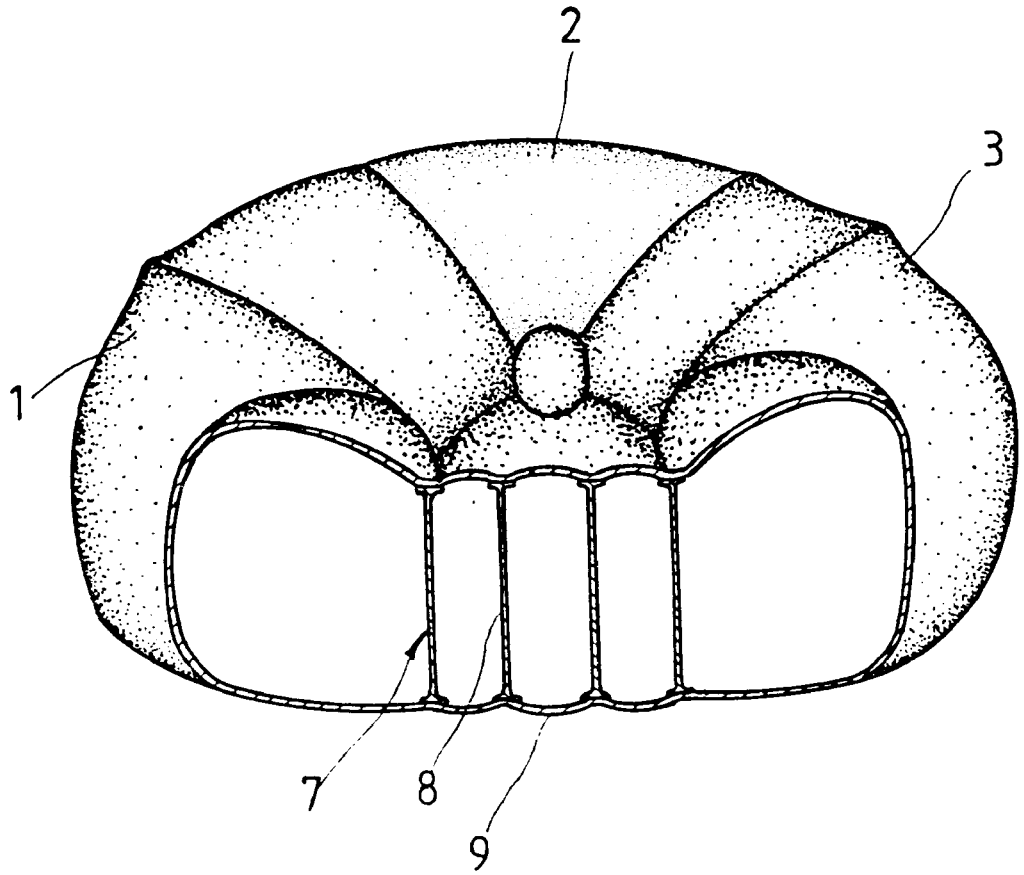
FIG. 3 is a front sectional view of the inflatable leisure chair of FIG. 1.
Figure 4:
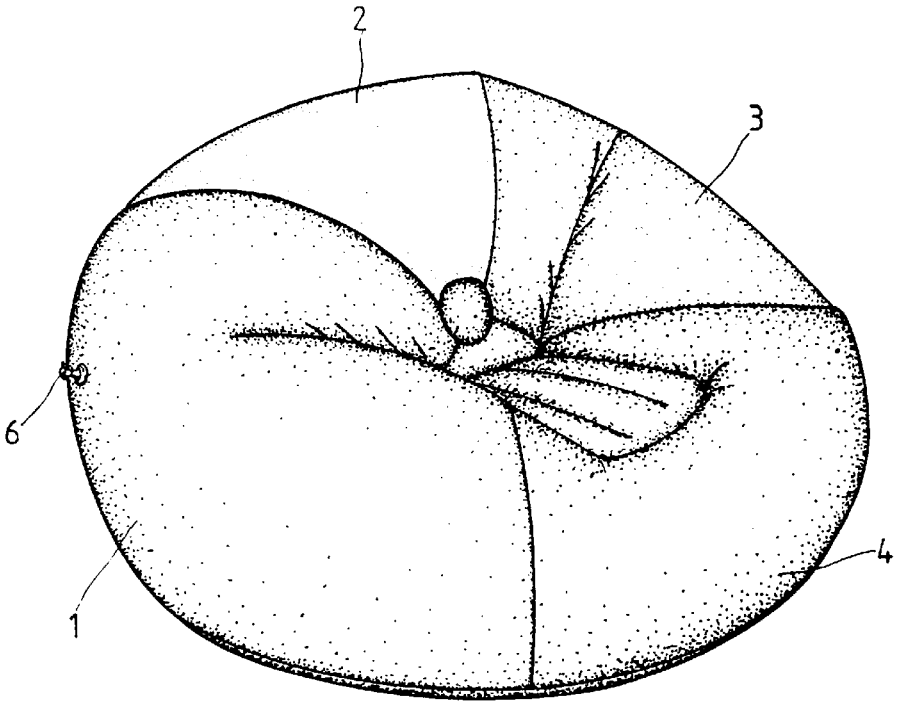
FIG. 4 is a complete perspective view of the inflatable leisure chair of FIG. 1.
Figure 5:
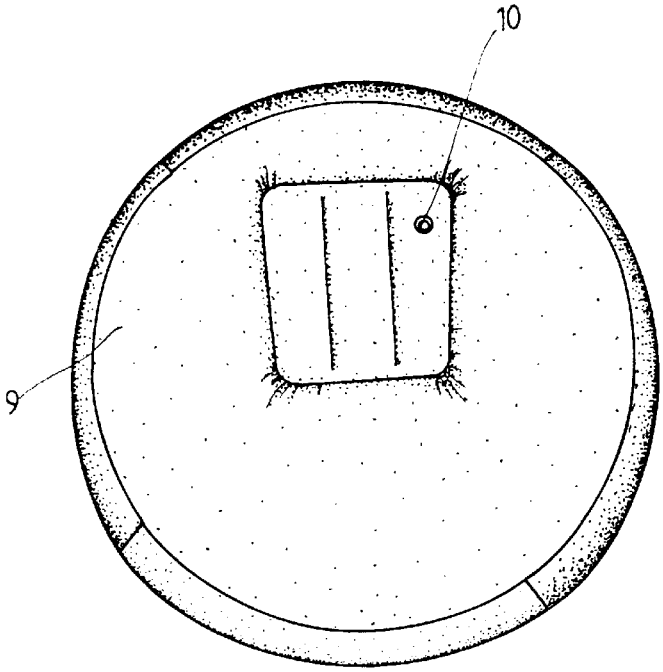
FIG. 5 is a bottom plan view of the inflatable leisure chair of FIG. 1.

Please refer to FIGS. 1 to 5 at the same time. The present invention relates to an inflatable leisure chair formed from multiple pieces of plastic sheets 1, 2, 3, 4, and 9 in the same or different colors connected to one another by radio heating according to a predetermined design. The plastic sheets 1, 2, 3 and 4 are sequentially radio heated along their adjacent edges to form a back, two armrests, and a seat of the chair and the plastic sheet 9 forms a bottom thereof. The radio heated plastic sheets 1, 2, 3, 4 and 9 together define a communicating space 5 in the inflatable chair. A valve 6 is provided on a proper position on the back, the armrests or the seat of the chair for filling air into the space 5 from the valve 6 to quickly inflate the chair to show a designed chair shape. To form the chair with a desired shape and to allow the seat of the chair to bear a considerable load, a portion 7 of the space 5 immediately below the plastic sheet 4 which forms the seat of the chair is particularly reinforced to form a reinforced space 7. In the reinforced space 7, a plurality of supporting beams 8 made of plastic material of high tensile strength and having predetermined height and thickness as well as an I-shaped cross section are separately radio heated at top and bottom surfaces thereof to and between inner surfaces of the seat plastic sheet 4 and the bottom plastic sheet 9, making the reinforced space 7 look like a cellular structure. With this reinforced space 7, the inflatable leisure chair of the present invention is strong enough to bear considerable load without causing a deformed seat 4. The supporting beams 8 may be radio heated to and between the seat plastic sheet 4 and the bottom plastic sheet 9 without sacrificing the communication of air in and between the space 5 and the reinforced space 7. Alternately, the supporting beams 8 may be so radio heated that the reinforced space 7 forms a closed space independent of the space 5 below the plastic sheets 1, 2, 3 forming the back and the armrests. In the case of an independent reinforced space 7, a second valve 10 is provided at a bottom side of the seat, as shown in FIG. 5.

What is claimed is:

1. An inflatable leisure chair comprising:

a) a plurality of plastic sheets having adjacent edges heat sealed together to form a back portion, two armrest portions and a seat portion of the chair;

b) a bottom plastic sheet affixed to the plurality of plastic sheets by heat sealing such that the bottom plastic sheet and the plurality of plastic sheets bound an enclosed space;

c) an air valve located in at least one of the bottom plastic sheet and the plurality of plastic sheets and communicating with the enclosed space to facilitate inflation and deflation of the chair; and, d) a plurality of plastic supporting beams, each having an I-shaped cross-section, an upper edge heat sealed to the plurality of plastic sheets forming the seat portion of the chair and a lower edge heat sealed to the bottom plastic sheet forming a cellular structure to reinforce the seat portion of the chair, the plurality of plastic supporting beams being located within the enclosed chamber bounded by the plurality of plastic sheets and the bottom plastic sheet.

2. The inflatable chair of claim 1 wherein the plurality of plastic supporting beams are spaced apart from each other.

3. The inflatable chair of claim 2 wherein spaces between adjacent ones of the plurality of plastic supporting beams are in communication with the enclosed space bounded by the plurality of plastic sheets and the bottom plastic sheet.

4. The inflatable chair of claim 2 wherein spaces between adjacent ones of the plurality of plastic supporting beams are not in communication with the enclosed space and further comprising a second air valve located in the bottom plastic sheet in communication with the spaces between adjacent plastic supporting sheets.

* * * * *